US006161315A

United States Patent [19]

Dalton

[11] Patent Number: 6,161,315

[45] Date of Patent: Dec. 19, 2000

[54] SHOE OUTSOLE HAVING A STABILITY RIDGE

[75] Inventor: Edward Dalton, Portland, Oreg.

[73] Assignee: Cutter & Buck, Seattle, Wash.

[21] Appl. No.: 09/238,692

[22] Filed: Jan. 27, 1999

[51] Int. Cl.[7] ..... A43B 5/00

[52] U.S. Cl. ..... 36/134; 36/59 R; 36/59 C; D2/906; D2/957

[58] Field of Search ..... 36/127, 134, 59 C, 36/59 R, 126, 128, 129, 67 R, 67 A, 66; D2/906, 957, 954

[56] References Cited

U.S. PATENT DOCUMENTS

| | | | |
|---|---|---|---|
| D. 406,938 | 3/1999 | Lin | D2/954 |
| D. 412,392 | 8/1999 | Singer | D2/951 |
| 2,433,303 | 12/1947 | Spini | 36/59 C |
| 3,793,750 | 2/1974 | Bowerman | 36/129 |
| 4,096,649 | 6/1978 | Saurwein | 36/59 C X |
| 4,161,828 | 7/1979 | Benseler et al. | 36/59 C X |
| 4,194,310 | 3/1980 | Bowerman | 36/128 |
| 4,454,662 | 6/1984 | Stubblefield | 36/59 C X |
| 4,562,651 | 1/1986 | Frederick et al. | 36/59 C X |
| 4,689,901 | 9/1987 | Ihlenberg | 36/59 C X |
| 4,885,851 | 12/1989 | Peterson | 36/127 |
| 5,203,097 | 4/1993 | Blair | 36/59 C |
| 5,313,718 | 5/1994 | McMahon et al. | 36/128 |
| 5,461,801 | 10/1995 | Anderton | 36/128 X |
| 6,016,613 | 1/2000 | Campbell et al. | 36/59 C |

*Primary Examiner*—Paul T. Sewell
*Assistant Examiner*—Jila M. Mohandesi
*Attorney, Agent, or Firm*—Graybeal Jackson Haley LLP

[57] ABSTRACT

A golf shoe includes an outsole having a forefoot, a shank, and a heel. A stability ridge is disposed on the outer surface and along the perimeter of the forefoot, the heel, or both the forefoot and the heel. This ridge provides additional traction and stability, particularly when the golfer swings his club to take a shot.

3 Claims, 3 Drawing Sheets

SHOE OUTSOLE HAVING A STABILITY RIDGE

TECHNICAL FIELD

The invention relates generally to shoes, and more particularly to an improved outsole for athletic shoes such as a golf shoes.

BACKGROUND OF THE INVENTION

The outsole of a shoe, which is the exposed portion of the sole that contacts the ground or other supporting surface, provides many characteristics of the shoe such as the shoe's traction and stability with respect to the intended supporting surface. For example, the outsole of an athletic shoe may include spikes or cleats that dig into and grip the playing field to prevent the wearer from slipping.

Unfortunately, although conventional golf-shoe outsoles typically provide sufficient traction and stability to prevent the golfer from slipping as he is walking on the golf course, they often fail to provide sufficient traction and stability as the golfer swings his club to hit the golf ball. This may cause the golfer to slip as he takes a shot. Such a slip may cause the golfer to make an errant shot, or worse yet, may cause the golfer to fall and injure himself.

SUMMARY OF THE INVENTION

In one aspect of the invention, a forefoot of an outsole includes an outer surface, a perimeter, and a ridge disposed on the outer surface along a portion of the perimeter. In another embodiment, the heel of the outsole includes such a ridge. In yet another embodiment, both the heel and the forefoot include such a ridge.

Such a ridge, whether installed on the forefoot, heel, or both the forefoot and the heel, provides added traction and stability for the golfer, particularly as he takes a shot.

DETAILED DESCRIPTION OF THE INVENTION

Figures 1, 3:
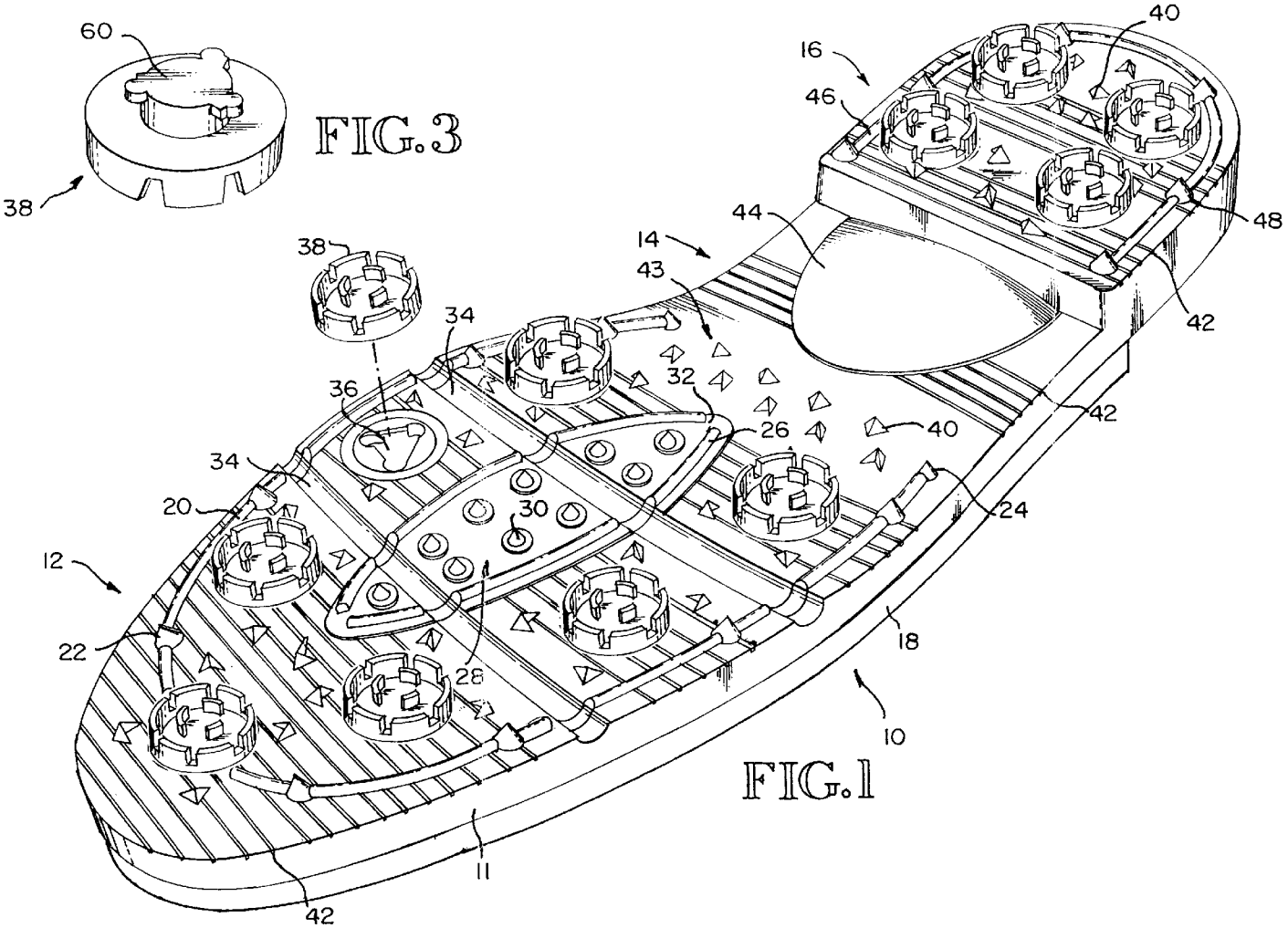
FIG. 1 is a perspective view of an outsole according to an embodiment of the invention.
FIG. 3 is a perspective view of an alternate spike from FIG. 1.

FIG. 1 is a perspective view of the bottom of a right-foot outsole/midsole assembly 10 according to an embodiment of the invention, it being understood that the corresponding left-foot outsole/midsole assembly has similar features.

The assembly 10 includes an outsole 11 having three sections: a forefoot 12, a midsection, i.e., shank 14, and a heel 16. The outsole 11 may have a "unit sole" construction, which means that the forefoot 12, shank 14, and heel 16 are formed as one piece. Alternatively, the forefoot 12 and the shank 14 may be formed as one piece, and the heel 16 later attached to the rear portion of the shank 14. The outsole 11 can be formed from any suitable material such as thermal plastic urethane (TPU). TPU has a high degree of torsional rigidity, and thus a TPU outsole provides a stable, secure base for a shoe. Furthermore, a TPU outsole is recognized as a desirable replacement for a leather outsole. Therefore, it is no wonder that TPU is regarded as one of the best materials from which to form the outsoles of high-end performance golf shoes.

The outsole/midsole assembly 10 also includes a midsole 18, which is attached to the inner surface (the surface facing the wearer's foot) of the outsole 11. The midsole 18 can be formed from any suitable material such as compression-molded Ethyl Vinyl Acetate (EVA). Because EVA is light-weight and resilient, an EVA midsole helps to dissipate shocks caused by walking and running and to alleviate the discomfort caused by spike or cleat pressure points.

The assembly 10 may also include other conventional pieces such as an insole and a heel filler, which are omitted from FIG. 1 for clarity. Furthermore, although the assembly 10 is described as including both an outsole and a midsole, the outsole 11 can be used on a shoe that lacks a midsole or that includes a midsole other than the midsole 18.

The forefoot 12 of the outsole 11 includes an outer stability ridge 20, which is located on the forefoot outer surface (the surface facing away from the wearer's foot) along at least a portion of the forefoot perimeter. As a golfer takes a shot, typically one or both of his feet twist in the direction of the shot, and one or both of his heels leave the ground. To prevent the golfer from slipping—particularly if the heel 16 leaves the ground—the ridge 20 stabilizes the golfer's foot as it, and thus the forefoot 12, twists. The ridge 20 performs this stabilization, however, without impeding the golfer's ability to twist his foot. Therefore, the ridge 20 provides twisting traction and stability without adversely affecting the golfer's swing. Furthermore, the ridge 20 provides additional traction and stability, particularly side-to-side traction and stability, while the golfer is in his pre-swing stance and as he stands, walks, or runs. In one embodiment, the ridge 20 is rounded, has a height (with respect to the forefoot outer surface) of approximately 1.75. millimeters (mm), a width of approximately 3.5 mm, and is disposed inward of the forefoot perimeter between approximately 2 and 25 mm. The distance between the ridge 20 and the forefoot perimeter may be relatively constant along the entire length of the ridge, or this distance may vary as shown in FIG. 1.

The outer stability ridge 20 may include one or more spiked protrusions 22, which are disposed at desired intervals along the ridge 20 and which increase the traction and stability provided by the ridge 20. In one embodiment, each of the spiked protrusions 22 is cone shaped, has a height of approximately 3.5 mm, and has a base radius of approximately 4.0 mm. The ridge 20 may also include spiked end protrusions 24. In one embodiment, the protrusions 24 have the same shape and dimensions as the protrusions 22. In another embodiment, each of the end protrusions 24 is cone shaped, has a height of approximately 2.5 mm, and has a base radius of approximately 3.0 mm.

The forefoot 12 may also include an inner stability ridge 26, which is disposed on the forefoot outer surface inward of the outer stability ridge 20. Like the outer ridge 20, the inner ridge 26 provides additional twisting and side-to-side traction and stability for the golfer. The inner ridge 26 may have the same shape and dimensions as the outer ridge 20, or may have a different shape or dimensions. Furthermore, although not shown in FIG. 1, the inner ridge 26 may include spiked protrusions like the protrusions 22 and 24 of the outer ridge 20.

The inner ridge 26 may partially or fully surround an inner area 28 of the forefoot 12 outer surface, and this inner area 28 may include spiked protrusions 30 for providing even more stability and traction, particularly as the golfer takes a shot. In one embodiment, the spiked protrusions 30 have the illustrated shape, a height of approximately 2.5 mm, an outer base radius of approximately 3 mm, and an inner base radius of approximately 1.75 mm. Furthermore, the inner ridge 26 and the spiked protrusions 30 may be located on a raised outer-surface portion 32, which in one embodiment has a height of approximately 1 mm.

Still referring to FIG. 1, the forefoot 12 may include one or more anatomical flex grooves 34, which allow the forefoot 12 to flex more easily while the golfer is running or walking. This extra flexibility causes the outsole 11 to feel lighter and more responsive to the golfer. In one embodiment, the grooves 34 are approximately 3 mm deep, and, to prevent the ridges 20 and 26 from splitting or cracking where they intersect the grooves 34, neither ridge extends across the grooves 34.

Additionally, the forefoot 12 may include one or more conventional receptacles 36 for receiving removable spikes or cleats such as conventional plastic alternate spikes 38. In one embodiment, the forefoot 12 includes seven receptacles 36 that are disposed inward of and along the forefoot perimeter. While installed, the spikes or cleats such as the spikes 38 provide additional traction and stability for the golfer.

Furthermore, the forefoot 12 may include mini spikes 40, which in one embodiment are molded as part of the forefoot 12. The spikes 40 provide additional traction and stability for the golfer as he is standing, walking, running, or taking a shot, and are particularly helpful if spikes or cleats such as the spikes 38 are not installed in the receptacles 36. In one embodiment, each spike 40 has a height of approximately 3.5 mm. The spikes 40 are further discussed below in conjunction with FIG. 2.

Moreover, the forefoot 12 may include one or more small flex grooves 42, which prevent flex cracks from forming in the forefoot outer surface.

Still referring to FIG. 1, the shank 14 extends from the heel 16 to approximately the last row 43 of the spikes 40 in the forefoot 12. Like the forefoot 12, the shank 14 may include one or more small flex grooves 42. The shank 14 may also include a shank piece 44, which often makes the outsole 11 more comfortable for the golfer. Because the heel 16 raises most if not all of the shank 14 off of the ground, a weak shank may allow the golfer's foot to sag. This sagging may cause the golfer pain or other discomfort. To prevent such sagging, the shank piece 44, which is significantly more rigid than the forefoot 12 and the shank 14, is included to fortify the shank 14. In one embodiment, the shank piece 44 has a rounded outer surface, is approximately 3.5 mm thick at its center, and is made from a conventional material such as a carbon fiber composite, which is relatively strong and light weight.

Still referring to FIG. 1, the heel 16 includes a stability ridge 46 that is located on the heel outer surface along at least a portion of the heel perimeter. The ridge 46 provides twisting traction and stability during the initial portion of the golfer's swing when the heel 16 is contacting the ground, and, like the outer ridge 20, provides additional traction and stability, particularly side-to-side traction and stability, while the golfer is in his pre-swing stance and as he stands, walks, or runs. In one embodiment, the ridge 46 has the same shape, height, and thickness as the outer ridge 20 and is disposed inward of the heel perimeter between approximately 2 and 5 mm. Like the ridge 20, the distance between the ridge 46 and the heel perimeter may be relatively constant or may vary along the length of the ridge 46.

The stability ridge 46 may include one or more spiked protrusions 48, which are disposed at desired intervals along the ridge 46 and which increase the traction and stability provided by the ridge 46. In one embodiment, the protrusions 48 each have the same shape and dimensions as the spiked protrusions 22 of the forefoot outer ridge 20.

Additionally, the heel 16 may include one or more receptacles 36 for receiving one or more spikes or cleats such as the alternate spikes 38, one or more mini spikes 40, and one or more small flex grooves 42. Furthermore, the outer surface of the heel 16 may be angled toward the forefoot 12 such that the back of the heel is higher than the front of the heel. Moreover, the heel 16 may include a hollow portion (not shown) that is filled with a conventional filler to provide additional comfort to the golfer.

Figure 2:
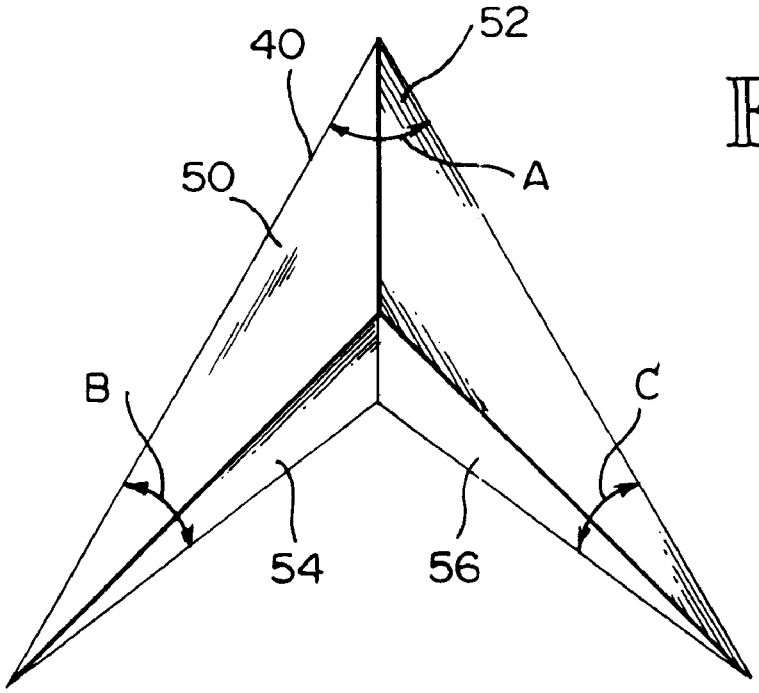
FIG. 2 is a top view of a mini spike from FIG. 1 according to an embodiment of the invention.

FIG. 2 is a top view of a mini spike 40 of FIG. 1 according to an embodiment of the invention. A first wall 50 makes an angle A with a second wall 52 at the base of the spike 40. The wall 50 makes an angle B with a third wall 54 at the spike base, and the wall 52 makes an angle C with a fourth wall 56 at the spike base such that $A+B+C<180°$. In one embodiment, $B=C$.

FIG. 3 is a perspective view of the connector side of an alternate spike 38 of FIG. 1. The spike 38 includes a conventional plug 60, which mates with a respective receptacle 36 (FIG. 1). To install the spike 38, the golfer aligns the plug 60 with the receptacle 36, inserts the aligned plug 60 into the receptacle 36, and then turns the spike 38 with a conventional spike key (not shown) until the plug 60 engages the receptacle 36.

Figure 4:
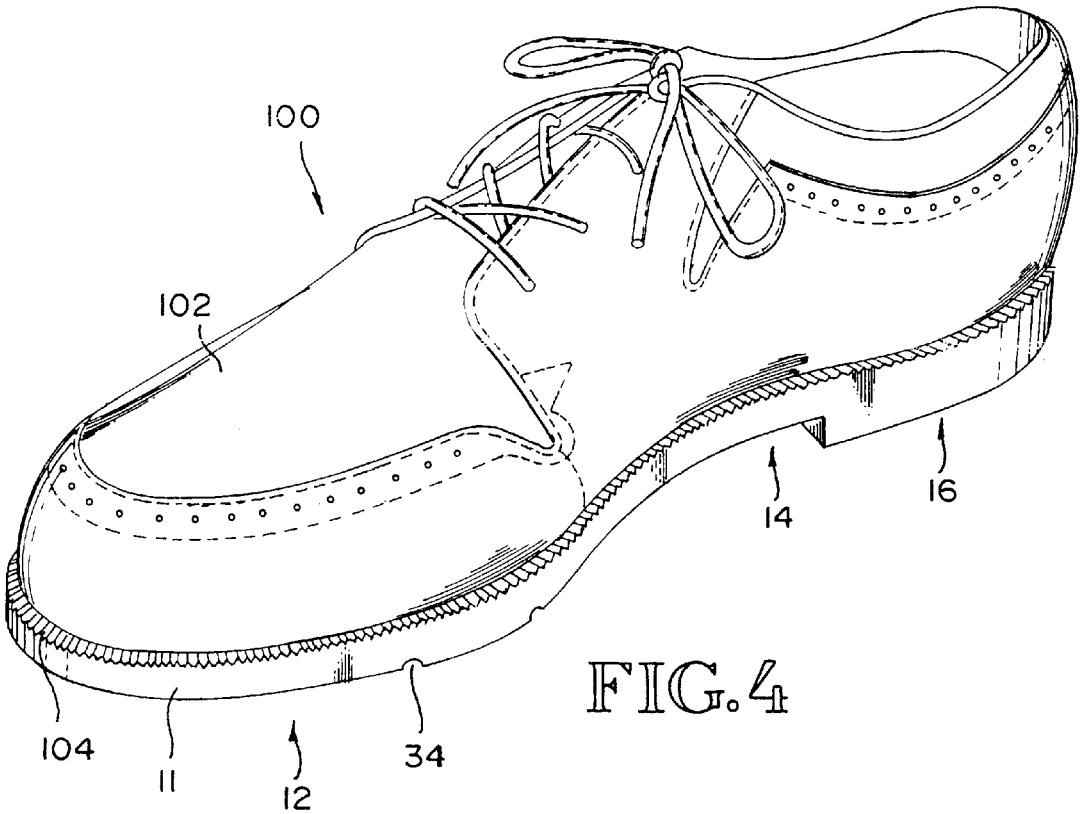
FIG. 4 is a perspective view of a shoe that incorporates the outsole or the outsole/midsole assembly of FIG. 1.

FIG. 4 is a perspective view of a right-foot golf shoe 100 according to an embodiment of the invention. The shoe 100 incorporates the outsole/midsole assembly 10 of FIG. 1 (midsole 18 not visible in FIG. 4), or omits the midsole 18 and incorporates the outsole 11 only. The shoe 100 includes a shoe upper 102, which can be formed from any conventional upper material such as leather and which is conventionally attached to the outsole 11. The shoe 100 may include a welt 104, which is the portion of the outsole 11 that extends beyond the outer perimeter of the upper 102. The welt 104 may include a conventional decorative treatment such as the "wheeling" pattern shown in FIG. 4.

From the foregoing it will be appreciated that, although specific embodiments of the invention have been described herein for purposes of illustration, various modifications may be made without deviating from the spirit and scope of the invention. For example, the shapes and dimensions given above may be varied in other embodiments of the invention. Also, although described in conjunction with a golf shoe, the outsole/midsole assembly 10 and the outsole 11 may be used with other types of shoes.

What is claimed:

1. An outsole, comprising:

a forefoot having an outer surface, an inner edge, and an outer edge;

a heel;

a shank disposed between the forefoot and the heel;

at least one flex groove disposed in the outer surface of the forefoot, extending from the inner edge of the forefoot to the outer edge of the forefoot, and having first and second opposite sides;

a first ridge disposed on the outer surface of the forefoot and intersecting the at least one flex groove adjacent to the inner and outer edges of the forefoot, respectively, the first ridge being discontinuous at the points of intersection;

at least one ridge protrusion disposed along the first ridge; and one or more surface protrusions disposed on the outer surface of the forefoot, each of the surface protrusions including, a first side having first and second edges, a second side having a first edge that abuts the first edge of the first side at a first angle, the second side having a second edge, a third side having a first edge that abuts the second edge of the second side at a second angle, a fourth side having a first edge that abuts the second edge of the first side at a third angle, and wherein the sum of the first, second, and third angles is less than 180°.

2. An outsole, comprising:

a forefoot having an outer surface and a forefoot perimeter;

a heel having an outer surface and a heel perimeter;

a shank disposed between the forefoot and the heel;

a first ridge disposed on the outer surface of the forefoot adjacent to a portion of the forefoot perimeter;

a second ridge disposed on the outer surface of the heel adjacent to a portion of the heel perimeter;

a third ridge disposed on the outer surface of the forefoot inward of the first ridge; and protrusions respectively disposed on the outer surfaces of the forefoot and the heel, each of the protrusions including, a first side having first and second edges, a second side having a first edge that abuts the first edge of the first side at a first angle, the second side having a second edge, a third side having a first edge that abuts the second edge of the second side at a second angle, a fourth side having a first edge that abuts the second edge of the first side at a third angle, and wherein the sum of the first, second, and third angles is less than 180°.

3. An outsole, comprising:

a forefoot having an outer surface and an outer perimeter, the outer surface having inner and outer regions, the inner region having an inner perimeter and being raised with respect to the outer region;

a heel;

a shank disposed between the forefoot and the heel;

a first ridge disposed on the outer region of the outer surface adjacent to a portion of the outer perimeter;

a second ridge disposed on the inner region of the outer surface adjacent to a portion of the inner perimeter; and at least one flex groove disposed in the inner and outer regions of the outer surface and intersecting the first and second ridges, the first and second ridges being discontinuous at the respective intersections with the flex groove.

* * * * *